US006649312B1

(12) United States Patent
Chari et al.

(10) Patent No.: US 6,649,312 B1
(45) Date of Patent: Nov. 18, 2003

(54) LENTICULAR IMAGING WITH INCORPORATED BEADS

(75) Inventors: Krishnan Chari, Fairport, NY (US); Richard P. Szajewski, Rochester, NY (US); Lyn M. Irving, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/171,012

(22) Filed: Jun. 12, 2002

(51) Int. Cl.[7] ..... G03C 3/02; G03C 3/00; G03C 7/14; G03C 1/825; G03C 1/76

(52) U.S. Cl. ..... 430/21; 430/396; 430/496; 430/501; 430/510; 430/523; 430/539; 430/946

(58) Field of Search ..... 430/946, 510, 430/21, 523, 501, 539, 396, 496

(56) References Cited

U.S. PATENT DOCUMENTS

| | | | | | |
|---|---|---|---|---|---|
| 992,151 | A | | 5/1911 | Berthon | 430/946 |
| 1,838,173 | A | | 12/1931 | Chretien | |
| 2,143,762 | A | | 1/1939 | Capstaff | 430/946 |
| 2,191,038 | A | | 2/1940 | Capstaff | 430/946 |
| 3,530,779 | A | * | 9/1970 | Alofs | 430/946 |
| 3,676,130 | A | * | 7/1972 | Burckhardt et al. | 430/946 |
| 4,272,186 | A | | 6/1981 | Plummer | |
| 5,744,291 | A | | 4/1998 | Ip | 430/946 |

* cited by examiner

*Primary Examiner*—Richard L. Schilling
(74) *Attorney, Agent, or Firm*—Arthur E. Kluegel

(57) ABSTRACT

Disclosed is light sensitive element comprising a support, at least one light sensitive silver halide emulsion layer, and a micro-bead layer comprising micro-beads a wherein the quantity of binder in the micro-bead layer is such that the micro-beads are not fully enclosed by the binder, thereby enabling the beads to function as microlenses. The invention also provides a camera combination and imaging method. Embodiments of the invention provide improved sensitivity and latitude in scene exposure range.

48 Claims, 3 Drawing Sheets

LENTICULAR IMAGING WITH INCORPORATED BEADS

CROSS-REFERENCE TO RELATED APPLICATIONS

This application is being filed as one of a group of five cofiled and commonly assigned applications filed under application Ser. Nos. 10/170,607, 10/171,012, 10/167,746, 10/167,794, and 10/170,148, the contents of which are incorporated herein by reference.

FIELD OF THE INVENTION

This invention is related to a light sensitive element comprising a support, at least one light sensitive silver halide emulsion layer, and a micro-bead layer comprising micro-beads a wherein the quantity of binder in the micro-bead layer is such that the micro-beads are not fully enclosed by the binder, thereby enabling the beads to function as micro-lenses. The micro-lenses act in conjunction with the incorporated silver halide emulsions to record scene information under extended low and high illumination conditions. Useful images are formed by extraction of the recorded scene information.

BACKGROUND OF THE INVENTION

In conventional photography, it is well known to record images by controllably exposing a photosensitive element to light from a scene. Typically, such a photosensitive element comprises one or more photosensitive layers supported by a flexible substrate such as film and/or a non-flexible substrate such as a glass plate. The photosensitive layers, which can have one or more light sensitive silver halide emulsions along with product appropriate imaging chemistry, react to the energy provided by the light from the scene. The extent of this reaction is a function of the amount of light received per unit area of the element during exposure. The extent of this reaction is greater in areas of the element that are exposed to more light during an exposure than in areas that are exposed to less light. Thus, when light from the scene is focused onto a photosensitive element, differences in the levels of light from the scene are captured as differences in the extent of the reaction in the layers. After a development step, the differences in the extent of the reaction in the layers appear as picture regions having different densities. These densities form an image of the original scene luminance.

It is characteristic of silver halide emulsions to have a non-linear response when exposed to ambient light from a scene. In this regard a photosensitive element has a lower response threshold that defines the minimum exposure at which the incorporated emulsions and associated chemistry begins to react so that different levels of exposure enable the formation of different densities. This lower threshold ultimately relates to the quantum efficiency of individual silver halide emulsion grains. Typically, all portions of a photosensitive element that are exposed to light at a level below the lower response threshold have a common appearance when the photosensitive element is developed.

Further, a photosensitive element also has an upper response threshold that defines the exposure level below which the emulsion and associated chemistries react so that different levels of exposure enable the formation of different densities. Typically, all portions of an element that are exposed at a level above the upper response threshold will again have a common appearance after the photosensitive element is developed. Thus elements can be said to have both a lower response threshold and an upper response threshold which bracket a useful range of exposures wherein the element is capable of reacting to differences in exposure levels by recording a contrast pattern with contrast differences that are differentiable. The exposure levels associated with these lower and upper thresholds define the exposure latitude of the element. To optimize the appearance of an image, therefore, it is typically useful to arrange the exposure so that the range of exposure levels encountered is within the latitude or useful range of the element.

It will be appreciated that many consumer and professional photographers prefer to use photosensitive elements, camera systems, and photography methods that permit image capture over a wide range of photographic conditions. One approach to meeting this objective is to provide photosensitive elements with wide latitude. However, extremely wide latitude photosensitive elements are fundamentally limited by the nature of the response of the individually incorporated silver halide grains to light. Accordingly, it is common to provide camera systems and photography methods that work to effectively extend the lower response limit and upper response limit of a photosensitive element by modifying the luminance characteristics of the scene. For example, it is known to effectively extend the lower response limit of the photosensitive element by providing supplemental illumination to dark scenes. It is also known to increase the quantity of the light acting on a photosensitive element without providing supplemental illumination by using a taking lens system designed to increase the amount of light from the scene that is available to the photosensitive element to make an exposure possible. However, lenses that pass substantial light also inherently reduce the depth-of field of the associated camera system. This solution is thus not universally suitable for pictorial imaging with fixed focus cameras since scenes may not then be properly focused. This solution is also not preferred in variable focused cameras as such lens systems can be expensive, and difficult to design, install and maintain.

It will also be appreciated that there is a direct relationship between the duration of exposure and quantity of light from the scene that strikes the photosensitive element during an exposure. Accordingly, another way known in the art for increasing the amount of light acting on a photosensitive element during an exposure is to increase the duration of the exposure using the expedient of a longer open shutter. This, however, degrades upper exposure limits. Further, increased shutter open time can cause the shutter to remain open for a period that is long enough to permit the composition of a scene to evolve. This results in a blurred image. Accordingly, there is a desire to limit shutter open time. Thus, what is also needed is a less complex and less costly camera system and photography method allowing the capture of images at action speed appropriate shutter times and particularly with cameras having a fixed shutter time.

Another way to increase the quantity of the light acting on a photosensitive element during an exposure is to use a conventional taking lens system to collect light from a scene and to project this light from the scene onto an array of micro-lenses such as an array of linear lenticular lenses that are located proximate to the film. An example of this is shown in Chretien U.S. Pat. No. 1,838,173. Each micro-lens concentrates a portion of the light from the scene onto associated areas of the film. By concentrating light in this manner, the amount of light incident on each concentrated exposure area of the photosensitive element is increased to a level that is above the lower response threshold of the film. This permits an image to be formed by contrast patterns in the densities of the concentrated exposure areas.

Images formed in this manner are segmented: the concentrated exposure areas form a concentrated image of the scene and remaining portions of the photosensitive element form a pattern of unexposed artifacts in the concentrated image. In conventionally rendered prints of such images this pattern has an unpleasing low contrast and a half-tone look much like newspaper print. Thus, the micro-lens or lenticular assisted low light photography of the prior art is ill suited for use in high quality markets such as those represented by consumers and professional photographers.

However, micro-lens arrays, and in particular, lenticular arrays have found other applications in photography. For example, in the early days of color photography, linear lenticular image capture was used in combination with color filters as means for splitting the color spectrum to allow for color photography using black and while silver halide imaging systems. This technology was commercially employed in the first color motion picture systems as is described in commonly assigned U.S. Pat. No. 2,191,038. In the 1940s it was proposed to use lenticular screens to help capture color images using black and white photosensitive element in instant photography U.S. Pat. No. 2,922,103. In the 1970's, U.S. Pat. No. 4,272,185 disclosed the use of lenticular arrays to create images having increased contrast characteristics. By minimizing the size of the unexposed areas, the line pattern became almost invisible and was therefore less objectionable. Also in the 1970s, it was proposed to expose photosensitive element through a moving lenticular screen U.S. Pat. No. 3,954,334. Finally, in the 1990's linear lenticular-ridged supports having three-color layers and an antihalation layer were employed for 3-D image presentation materials. These linear lenticular arrays were used to form interleaved print images from multiple views of a scene captured in multiple lens camera. The interleaved images providing a three dimensional appearance. Examples of this technique is disclosed by Lo et al. in U.S. Pat. No. 5,464,128 and by Ip, in U.S. Pat. No. 5,744,291. It is recognized that these disclosures relate to methods, elements and apparatus adapted to the formation of 3-D images from capture of multiple scene perspectives that are suitable for direct viewing. They fail to enable photography with shutter times suitable for use in hand-held cameras.

Thus, while micro-lens assisted photography has found a variety of uses, it has yet to fulfill the original promise of effectively extending the lower response threshold of a photosensitive element to permit the capture of commercially acceptable images at low scene brightness levels. What is needed, therefore, is a method and apparatus for capturing lenticular images on a photosensitive element and using the captured photosensitive element image to form a commercially acceptable print or other output.

It can also occur that it is useful to capture images under imaging conditions that are above the upper response threshold of the photosensitive element. Such conditions can occur with bright scenes that are to be captured under daylight, snow pack and beach situations. Typically, cameras use aperture control, shutter timing control and filtering systems reduce the intensity of light from the scene so that the light that confronts the photosensitive element has an intensity that is within the upper limit of the photosensitive element. However, these systems can add significant complexity and cost to the design of the camera. Further, the expedient of using a lens with a more open aperture to improve the lower threshold limit as discussed earlier simultaneously passes more light and degrades the exposure at the upper response threshold. Thus, what is also needed is a simple, less costly, camera system and photography method for capturing images over a range of scene brightness levels that is greater than the latitude of the photosensitive element.

It is a problem to be solved to provide a photographic element having improved sensitivity and latitude in scene exposure range.

SUMMARY OF THE INVENTION

The invention provides a light sensitive element comprising a support, at least one light sensitive silver halide emulsion layer, and a micro-bead layer comprising micro-beads a wherein the quantity of binder in the micro-bead layer is such that the micro-beads are not fully enclosed by the binder, thereby enabling the beads to function as micro-lenses. The invention also provides a camera combination and imaging method employing such an element.

Embodiments of the invention provide improved sensitivity and latitude in scene exposure range.

DETAILED DESCRIPTION OF THE INVENTION

Figure 1:
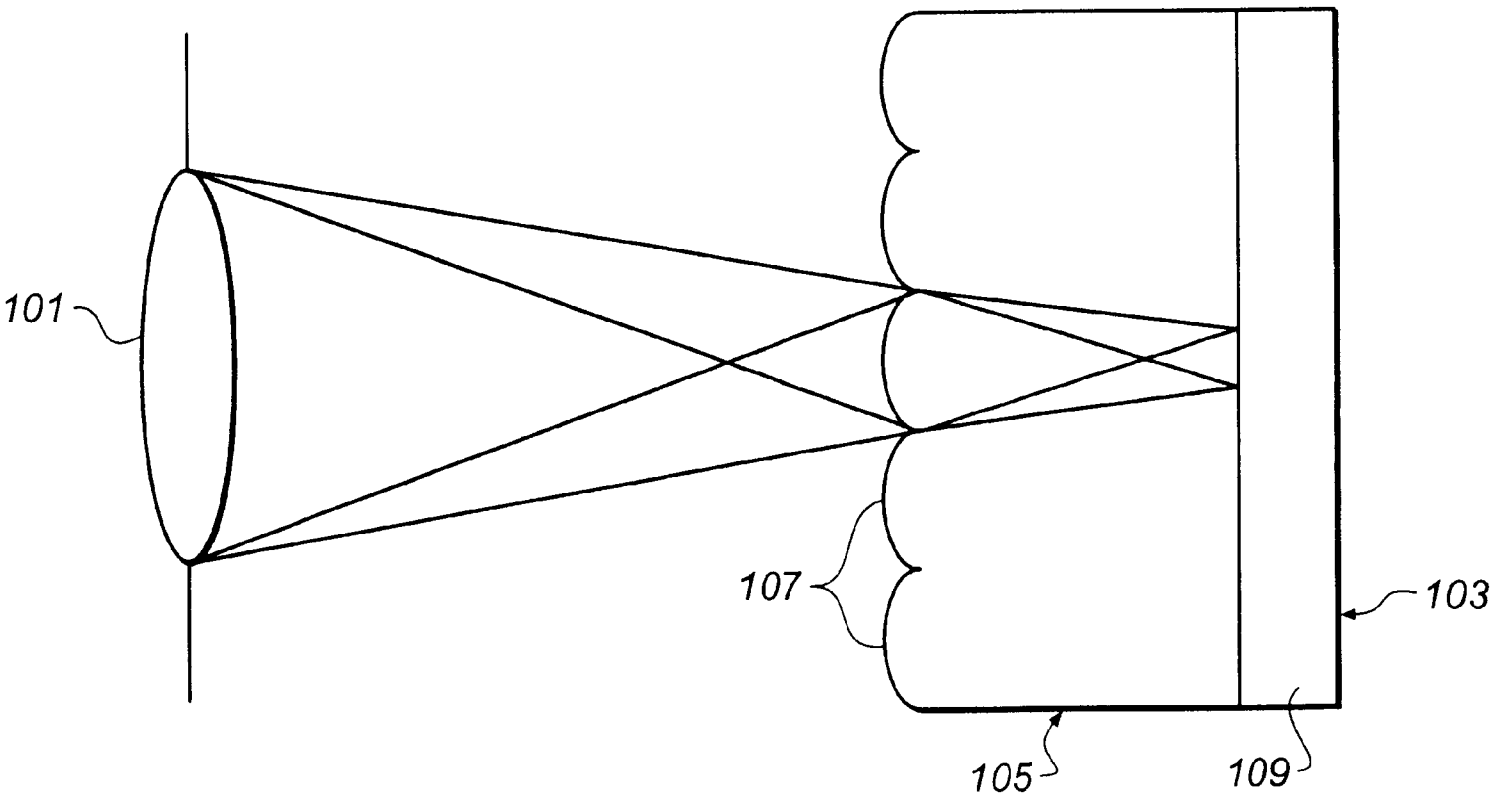
FIG. 1 shows the exposure of a micro-lens photographic element in a camera.

An object of the invention is to provide high sensitivity silver halide elements useful for providing images under low light conditions. It is a further object of the invention to provide high sensitivity silver halide elements having reduced sensitivity to background radiation, improved shelf-keep and capable of recording images under a variety of illumination conditions. It is yet another object of this invention to provide silver halide elements having a wide exposure latitude.

The objects of the invention are met by provided by a light sensitive element comprising a support, at least one light sensitive silver halide emulsion layer and a micro-bead layer comprising micro-beads and a binder enabling the formation of a micro-lens arrays. The quantity of binder in the micro-bead layer is such that the micro-beads are not fully enclosed by the binder and the protrusion of the beads from the layer forms the micro-lenses. Here, the combination of beads and low quantities of binder enables the formation of micro-lenses. A micro-lens array is formed from multiple micro-lenses. The individual micro-lenses are convergent lenses in that they are shaped so as to cause light to converge or be focused. As such, they form convex projections from the film structure. The individual projections are shaped as portions of perfect or imperfect spheres. Light fracturing is enabled by the beads acting as lenses. The micro-lenses extend the effective image capture latitude of a photographic film by fracturing light from a scene to record a first exposure range and a second exposure range of light from a scene onto a film having a fixed exposure range so as to capture image information from scenes having a wider exposure range. The micro-lenses effectively enhance exposure in the first range and retard exposure in the second range. This invention further provides methods for recovering an acceptable output image from the imaging information recorded on the film. After photoprocessing, the formed images are read our by scanning and digitally reconstructed.

In another useful readout path, the real image is reconstructed by reading through the incorporated micro-lens array. An appropriate field lens is employed to adjust the plane at which the dot pattern reforms a true image. The field lens thereby enables optical compatibility between taking and reading stages. Accordingly, the optically compressed and encoded information is optically reconstructed to reproduce the original scene content at a suitable and convenient imaging plane in a form that can be directly imaged onto a solid state sensor or a photosensitive material or directly visualized. In one embodiment, the micro-bead layer is situated on an opposing side of the photographic support relative to a light sensitive silver halide layer. In another embodiment, the micro-bead layer is situated on the same side of the photographic support relative to a light sensitive silver halide layer. In both embodiments, the light sensitive material is exposed, in camera, such that the exposing light strikes the micro-bead layer before striking the light sensitive silver halide layer.

In both embodiments, the binder can be gelatin or the other known photographic binders. The binder can be hardened so as to maintain structure and function during and following photo-processing. Alternatively, the binder can be unhardened and removable during photo-photo-processing. The use of micro-lens arrays in image taking systems when combined with photonic image reconstruction of recorded scene information enables photography under low light conditions typically beyond the scope of standard photographic techniques. The method has special applicability to fixed-focus cameras, such as one-time-use cameras, since the system depth-of-field is controlled by the f-number of the camera lens while the effective system speed is Controlled by the f-number of the micro-lenticular lens array. This allows very high-speed photography to be achieved with what would otherwise be considered low sensitivity emulsions in "slow" camera/lens systems having a large depth-of-field. Additionally camera manufacturability is improved because "slow" camera systems having a large-depth-of-field also have a large-depth-of-focus and can be manufactured economically to looser tolerances than can "fast" camera/lens systems with smaller depth-of-field and depth-of-focus characteristics. Further, the shelf-keeping and radiation insensitivity of silver halide based imagers are improved since stable, low sensitivity silver halide emulsion grains can be gainfully employed. The elements of the invention are further capable of recording images under a wide range of illuminant levels. On exposure, light is fractured into a pattern of concentrated fractions and unconcentrated fractions. Light concentration is enabled by the beads acting as lenses. The concentrated fractions of the light expose a first area on the film and form a pattern of dots on the film after development and according to the geometric characteristics of the micro-lenses, when the light from the scene is within a first exposure range. The unconcentrated fractions expose a second area of the film so that the film can record imaging information from an exposure that is within a second range wherein the first exposure range and second exposure range together are greater than the predetermined range of the film. The film is then photo-processed Any art know photo-processing can be employed. The photo-processing can comprise a development step with optional desilvering steps. The photo-processing can be by contacting the film with photo-processing chemicals or art know agents enabling photo-processing. The photo-processing can be by contacting the film with aqueous solutions of photo-processing chemicals or pH adjusting agents or both. Alternatively, the film can be an art known photothermographic film that is photo-processed by heating or by a combination of contacting with photo-processing enabling agents and heat. After photo-processing a determination is made as to whether an image recorded on the film contains an image formed by hyper exposure, on an image formed by hypo-exposure or some combination thereof. The film is scanned and the scanned image is processed to recover an image based upon image data from either or both of the hyper exposed areas or the hypo exposed areas. The output image is optionally further improved and processed for its intended use. A camera system useful for fracturing scene light and forming images on a film includes a taking lens system that focuses light from a scene onto a film and interposed between taking lens system and film is a micro-lens array.

Each lens in the micro-lens array receives a portion of the light passing from the taking lens system and fractures this light into a compressed fraction and an uncompressed fraction. The concentration is achieved because each lens of the micro-lens array has a predetermined cross sectional area. Light from the image strikes this predetermined cross sectional area and a fraction of the light incident on the lens is concentrated. This concentrated fraction of light is directed onto a first exposure area of film having a smaller cross section than that of lens. This increases the effective exposure level on the film in the first exposure area and permits the emulsion to react to form an image. However, some of the light incident on the lenses, or light that is poorly focused by the lenses or light that is scattered is not concentrated onto the first exposure area. Instead, this unconcentrated fraction of the light passes to film without substantial concentration and is incident on second exposure area enabling formation of a residual surround image therein. This unconcentrated fraction of light is less than the amount of light that would be incident on film in the event that the micro-lens array was not interposed between the scene and the film during the same exposure. Thus, the micro-lens array effectively filters light from the scene that is incident on second area so that a greater quantity of light must be available during the exposure in order for an image to be formed on the film. Accordingly, the micro-lens array shields light within a second exposure range to create a second exposure suitable for producing a differentiable image over the range indicated by second image range on film. It will be appreciated that the upper and lower limits of the second exposure range are within the actual film latitude and therefore, can be recorded on film. This effectively extends the upper exposure threshold of film. It will be further appreciated that while this discussion has been framed in terms of a specific embodiment directed towards silver halide photography intended for capturing human visible scenes, the invention can be readily applied to capture extended scene luminance ranges and spectral regions invisible to humans, and the light sensitive material can be any light sensitive material known to the art that has the requisite imaging characteristics. The effective increase in latitude enabled can be at least 0.15 log E, while it is preferably at least 0.3 log E, more preferably at least 0.6 log E and most preferably at least 0.9 log E. In a useful imaging system a camera lens and micro-lens array jointly image a scene onto the light sensitive material. The light concentration or useful photographic speed gain on further concentrating light focused by a camera lens with a circular projection micro-lens is the square of the ratio of the two lens f-number's. Speed gain (in log relative Exposure) in such a system can be determined as the speed gain equals 2×log (camera lens f-number/micro-lens f-number). The light concentration or useful photographic speed gain of cylindrical micro-lenses allow only the square root of such an improvement because they concentrate light in only one direction. The concentration of light by the micro-lens array enables both a system speed gain and forms a lens pattern on the light sensitive material.

The dimensions of the camera and the detailed characteristics of the camera lens dictate the exposure pupil to image distance, i.e. the camera focal length. The camera image is formed at the micro-lenses. The micro-lens characteristics dictated the micro-lens focal length and the micro-lens images are formed at the light sensitive layers. The camera lens f-number controls the depth-of-focus and depth-of-field of the camera while the micro-lens f-number controls the effective aperture of the camera. By using a stopped down f-number for the camera lens, excellent sharpness along with wide depth of focus and depth of field are obtained. By using an opened f-number for the micro-lenses, high system speed is obtained with emulsions that are typically thought of as "slow." This extra speed allows available light photography without the thermal and radiation instability typically associated with "fast" emulsions. Accordingly, a useful combination of camera lens and micro-lens f-number's will be those that enable system speed gains. System speed gains of 0.15 log E, or ½-stop, are useful while system speed gains of at least of 0.2 log E are preferred, 0.3 log E more preferred, 0.5 log E even more preferred and 0.8 log E or more especially preferred. While any micro-lens f-number that enables a speed gain with a camera lens having adequate depth-of-field for an intended purpose can be gainfully employed, typically micro-lens f-number's of 1.5 to 16 are useful, while micro-lens f-number's in the range of f/2 to f/7 are preferred, and micro-lens f-number's in the range of f/3 to f/6 are more preferred.

While any useful surface coverage of micro- lenses, can be employed, the ratio of the projected area of the micro-lenses to the projected area of the photographic element, or film, can be at least 20 percent, preferably at least percent, more preferably at least 50 percent, even more preferably at least 70 percent, and up to 80 percent or 95 percent or even at the close-packed limit. The precise degree of surface coverage can be adjusted to enable increased exposure latitude while maintaining useful photographic graininess and sharpness. It will be appreciated that adjusting the surface coverage can be a method of partitioning light between the described first exposure range and second exposure range and an undisturbed range coincident with the natural exposure range of the light sensitive material. Accordingly, it can be preferred that the fill-factor be less than 95%, or more preferred that it be less than 90% or even more preferred that it be less than 85% or even less than 75%.

While any useful number of micro-lenses can be employed per image frame to achieve the desired results, it is recognized that the actual number to be employed in any specific configuration depends on the configuration. For example, when a desired micro-lens focal length is fixed by forming integral micro-lenses on the support side of a photographic material and the micro-lens f-number is fixed by the desired system speed gain for the combined lens system, micro-lens apertures or pitches of 10 to 100 microns can be encountered. So, a 135-format frame, roughly 24 by 36 mm in extent, can have between about 86 thousand and 8.6 million micro-lenses at full surface coverage. Emulsion side micro-lenses, with their shorter focal-length can have useful apertures or pitches between about 3 and 30 microns which means roughly 960 thousand to 96 million micro-lenses per 135-format frame at full surface coverage. Camera mounted micro-lenses with their greater freedom in focal lengths can range up to 500 microns or even larger in aperture or pitch.

FIG. 1 illustrates a camera having a taking lens 101, a light sensitive element 103 and an interposed micro-lens array 105. Other camera elements such as a shutter and release, fixed or variable aperture stops, also knows as diaphragms, film reels and advance mechanisms, viewfinders and such are omitted for clarity. On imagewise exposure in the camera the interposed bead formed micro-lenses 107 acts to concentrate the light falling on specific portions of the light sensitive element thus effectively increasing the system sensitivity of the camera while producing a dot exposure pattern on the light sensitive element. The camera lens and micro-lens array jointly image a scene onto the light sensitive material. The concentration of light by the micro-lens array enables both a system speed gain and forms a dot pattern on the light sensitive material. The figure shows an integral micro-lens array on the support of the photographic material. This configuration can be made by forming micro-lenses on the support side of a conventional photographic material. The dimensions of the camera and the detailed characteristics of the camera lens dictate the pupil to image distance. In this figure, the exposure pupil position or aperture position is roughly coincident with the camera lens.

Figure 2:
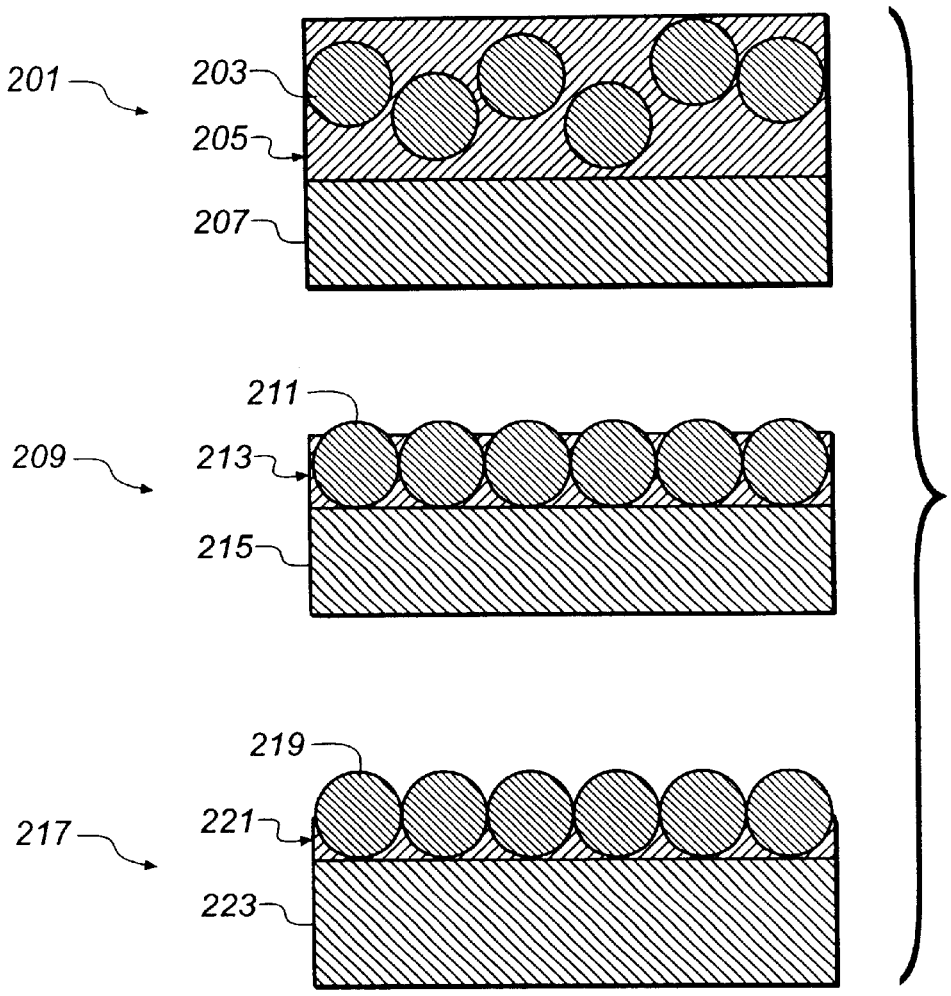
FIG. 2 shows micro-beads forming micro-lenses.

FIG. 2 illustrates a photographic element 201 with micro-beads 203 in a micro-bead layer 205 arranged on the remainder of the light sensitive layers and support, shown combined as 207. Here the quantity of binder in the micro-bead layer 205 is such that the beads are immersed in the layer and do not lead to the formation of a curved surface that can act as a lens. The figure additionally shows an inventive photographic element 209 with micro-beads 211 in a micro-bead layer 213 arranged on the remainder of the light sensitive layers and support, shown combined as 215. Here the quantity of binder in the micro-bead layer is such that the beads are not fully immersed in the layer 213 and do lead to the formation of a curved surface that can act as a lens. The figure shows a further inventive photographic element 217 with micro-beads 219 in a micro-bead layer 221 arranged on the remainder of the light sensitive layers and support, shown combined as 223. Here the quantity of binder in the micro-bead layer 221 has been further reduced from that illustrated at 209 and the beads lead to the formation of a more pronounced curved surface that can act as a lens. Photographic elements 209 and 217 contain sufficient numbers of micro-beads to lead to a high surface coverage and a near close packed bead arrangement as illustrated.

Figure 3:
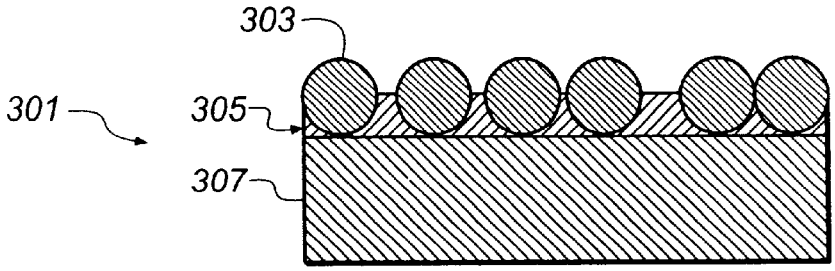
FIG. 3. shows an additional example of micro-beads forming micro-lenses

FIG. 3 shows a further inventive photographic element 301 with micro-beads 303 in a micro-bead layer 305 arranged on the remainder of the light sensitive layers and support, shown combined as 307. Here the quantity of binder in the micro-bead layer 303 is such that the beads are not fully immersed in the layer and the curved bead surface leads to the formation of a pronounced curved surface for the entire element. It is this curved surface that can act as a lens.

A further feature illustrated here is that the beads are present at a lower surface coverage so that a near close packed arrangement is not achieved but rather a random pattern of micro-lenses is formed. While any surface coverage of beads that form lenses can be employed, the ratio of the projected area of the micro-beads to the projected area of the photographic element can be at least 20 percent, preferably at least 35 percent, more preferably at least 50 percent, even more preferably at least 65 percent, most preferably at least 80 percent and especially preferably near the hexagonal close-packed limit.

The micro-lenses formed in this manner can be permanent and survive photochemical processing or can be temporary and be destroyed or removed during photochemical processing. Any art known technique for retaining or destroying a photo-layer can be employed to this end. One expedient for facilitating the desired degree of permanence relates to the hardening or cross-linking of the binder employed in the micro-lens layer. Alternatively, the material chosen for the micro-lenses can itself be selectively destroyed during photochemical processing.

Figure 4:
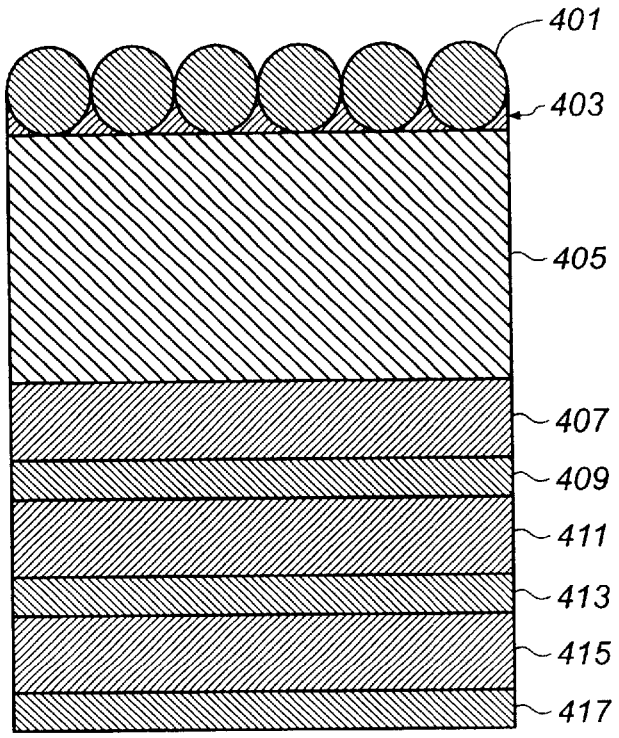
FIG. 4 shows micro-beads forming micro-lenses in a layer arranged on a support with light sensitive silver halide layers arrayed on the opposing side of the support.

FIG. 4 illustrates further details of a light sensitive element with micro-lenses formed from micro-beads arranged on the opposite side of a support from light sensitive silver halide layers. Here the micro-beads 401 are in a micro-bead layer 403 having sufficient binder to bind the micro-beads while forming a curved surface that can act as a lens. The micro-bead layer is adjacent to a flexible photographic support 405. Optional intermediate auxiliary layers are omitted for clarity. The opposing face of the support bears a blue light sensitive color forming unit 407, a green light sensitive color forming unit 411 and a red light sensitive color forming unit 415 with interlayers 409 and 413 and protective antihalation layer 417. The interlayers and auxiliary layers (not shown) can further comprise dyes, stabilizers and scavengers as known in the art. The color forming units can comprise one or more layers as known in the art. In another embodiment, not shown, the color forming layers can be replaced by one or more ortho or pan sensitized layers to form a black and white recording material.

Figure 5:
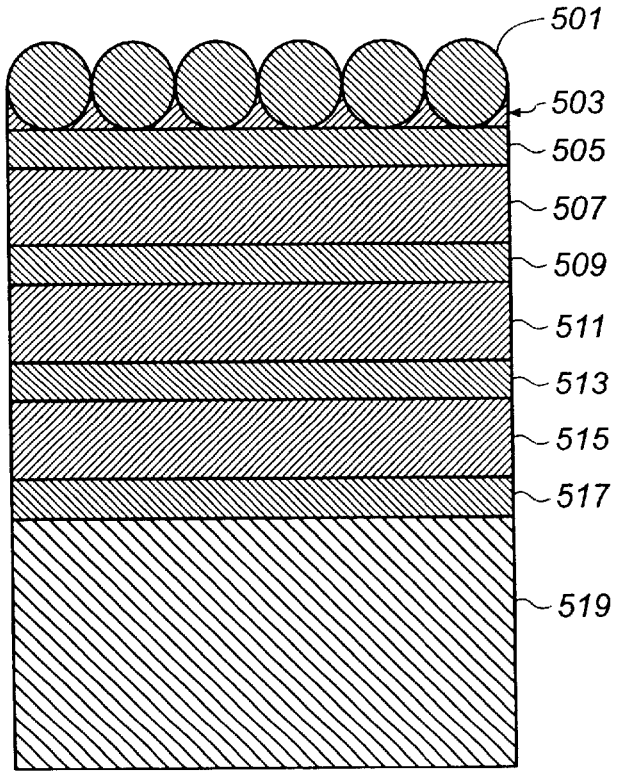
FIG. 5 shows micro-beads forming micro-lenses arranged on a support with light sensitive silver halide layers arrayed on the same side of the support.

FIG. 5 illustrates further details of a light sensitive element with micro-lenses formed from micro-beads arranged on the same side of a support as light sensitive silver halide layers. Here the micro-beads 501 are in a micro-bead layer 503 having sufficient binder to bind the micro-beads while forming a curved surface that can act as a lens. The same face of the support bears a blue light sensitive color forming unit 507, a green light sensitive color forming unit 511 and a red light sensitive color forming unit 515 with interlayers 505, 509 and 513 and antihalation layer 517. The interlayers and auxiliary layers (not shown) can further comprise dyes, stabilizers and scavengers as known in the art. The light sensitive layers are between the micro-bead layer and the flexible photographic support 519. The color forming units can comprise one or more layers as known in the art. In another embodiment, not shown, the color forming layers can be replaced by one or more ortho or pan sensitized layers to form a black and white recording material.

Useful parameters for micro-lenses formed from micro-beads and their relationship to the light sensitive layers of a photographic element follow from these definitions:

Micro-lens radius is the radius of curvature of the spherical portion protrusion of micro-lens. For aspherical micro-lenses this value varies across the surface of the micro-lens. This radius is approximately the radius of the micro-beads as expanded by the thickness of the covering binder.

Micro-lens aperture is the diameter of the protrusion formed by the micro-beads from the photographic element surface. This diameter is perforce less than or equal to twice the micro-lens radius. The lens aperture is influenced by the quantity of binder in the micro-lens-forming layer. A fully covered micro-bead exhibits no protrusion and thus forms no radius, as in photographic element 201. Conversely, a minimally covered or half-exposed bead forms a protrusion having a diameter just larger than the bead diameter, as in photographic element 217 or 301. Intermediate quantities of binder enable formation of intermediate micro-lens diameters from the same sized beads as in photographic element 209.

Micro-lens focal-length is distance from micro-lens to photosensitive layers. For micro-lenses on the opposing side of a support relative to a light sensitive layer this is typically about the thickness of the support, i.e. the thickness of support 405. For micro-lenses on the same side of a support relative to a light sensitive layer this is typically about the thickness of layers separating the micro-lenses from a light sensitive layer, i.e. the thickness of interlayer 505. It is appreciated that the use of micro-lenses enables distinct color records to be preferentially enhanced for sensitivity. This feature can be especially important in specific unbalanced lighting situations such as dim incandescent lighted interiors that are blue light poor and red light rich. For example, for cameras and films intended for use in incandescent lighted environments, the micro-lenses can be designed to preferably focus on the blue light sensitive layers, thereby providing a larger boost in the blue light regime and enabling a more color-balanced situation. Other colors can be likewise advanced as desired.

Micro-lens f-number is the micro-lens aperture divided by the micro-lens focal-length.

For spherical micro-lenses, the desired micro-lens focal length can be used to define an appropriate micro-lens radius following a lens equation. The micro-lens radius is the micro-lens focal-length times $(n_2-n_1)/n_2$ where $n_1$ is the refractive index of the material outside the micro-lens (typically air with a refractive index of unity) while $n_2$ is the refractive index of the micro-lens and appended photographic material (plastics as used in photographic supports and photographically useful gelatin typically have a refractive index of 1.4 to 1.6). Superior optical properties are provided when the refractive index of the distinct materials used to form a micro-lens, i.e. the micro-bead and the supporting binder are as similar as possible. It is preferred that the ratio of the refractive index of the micro-beads to the refractive index of the binder be between 0.8 and 1.2, more preferred that the ratio be between 0.9 and 1.1, and even more preferred that the ratio be between 0.95 and 1.05. However, purposeful mismatches in refractive index can facilitated light scatter and reflection and thereby influence the extent of residual image formation.

Following the know refractive indices of typical photographic system components, useful micro-lenses formed from appropriate beads in typical photographic binders will have a micro-lens focal length about 3 times the micro-lens radius ($(n_2-n_1)/n_2 \sim 1/3$). Accordingly, micro-lenses formed on a flexible photographic support suitable for use in roll film and located on the opposing side of the support from light sensitive layers, as shown in FIG. 4, will have a useful radius defined by the thickness of the support and the micro-lens layer. As disclosed earlier, the micro-lens layer itself will typically have a thickness of about the micro-bead diameter in order to enable the formation of a lens surface. Although any useful combination of support thicknesses and lens radius can be employed, it is preferred to employ photographic support of a thickness suitable for use in roll films. These preferred flexible photographic supports are between about 60 and 180 microns thick. It follows that they are best employed micro-lenses having a radius similar to the support thickness, or with micro-beads having a radius of about 60 to 180 microns. Alternatively, the ratio of the bead diameter to the support thickness can be between 0.8 and 1.2, more preferable between 0.9 and 1.1 and most preferably between 0.95 and 1.05. Likewise, micro-lenses located on the same side of the support as light sensitive layers, as shown in FIG. 5, will have a useful radius defined by the thickness of the micro-lens layer and any overlying layers separating the micro-lens layer from a light sensitive layer. While any useful combination of support thicknesses and lens radius can be employed, it is preferred to employ as little material between the light sensitive layers and the front surface of the photographic material so as to facilitate photo-processing in a way consistent with layer integrity. Again, since the micro-lens layer itself will typically have a thickness of about the micro-bead diameter in order to enable the formation of a lens surface, it will be preferred that the thickness of interlayer 503 be about equal to the micro-bead radius. Accordingly, the ratio of the bead radius to the interlayer thickness can be between 0.8 and 1.2, more preferable between 0.9 and 1.1 and most preferably between 0.95 and 1.05.

The beads useful in the invention are solid rather than liquid or fluid in character. They are curvilinear in shape to aid in the formation of a monolayer having a low percentage overlap. They may be prepared in any manner suitable for obtaining the desired bead shape. Suitable methods are suspension and emulsion polymerization methods such as the limited coalescence technique as described by Thomas H. Whitesides and David S. Ross in "J. Colloid Interface Science" 169. 48–59 (1995).

The limited coalescence method includes the "suspension polymerization" technique and the "polymer suspension" technique. A preferred method of preparing polymer particles in accordance with this invention is by a limited coalescence technique where poly-addition polymerizable monomer or monomers are added to an aqueous medium containing a particulate suspending agent to form a discontinuous (oil droplet) phase in a continuous (water) phase. The mixture is subjected to shearing forces, by agitation, homogenization and the like to reduce the size of the droplets. After shearing is stopped, an equilibrium is reached with respect to the size of the droplets as a result of the stabilizing action of the particulate suspending agent in coating the surface of the droplets, and then polymerization is completed to form an aqueous suspension of polymer particles. This process is described in U.S. Pat. Nos. 2,932,629; 5,279,934; and 5,378,577; which are incorporated herein by reference.

In the "polymer suspension" technique, a suitable polymer is dissolved in a solvent and this solution is dispersed as fine water-immiscible liquid droplets in an aqueous solution that contains colloidal silica as a stabilizer. Equilibrium is reached and the size of the droplets is stabilized by the action of the colloidal silica coating the surface of the droplets. The solvent is removed from the droplets by evaporation or other suitable technique resulting in polymeric particles having a uniform coating thereon of colloidal silica. This process is further described in U.S. Pat. No. 4,833,060 issued May 23, 1989, incorporated by reference.

In practicing this invention using the suspension polymerization technique, any suitable monomer or monomers may be employed such as, for example, styrene, vinyl toluene, p-chlorostyrene; vinyl naphthalene; ethylenically unsaturated mono-olefins such as ethylene, propylene, butylene and isobutylene; vinyl halides such as vinyl chloride, vinyl bromide, vinyl fluoride, vinyl acetate, vinyl propionate, vinyl benzoate and vinyl butyrate; esters of alpha-methylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyl-alpha-chloroacrylate, methyl methacrylate, ethyl methacrylate and butyl methacrylate; acrylonitrile, methacrylonitrile, acrylamide, vinyl ethers such as vinyl methyl ether, vinyl isobutyl ether and vinyl ethyl ether, vinyl ketones such as vinyl methylketone, vinyl hexyl ketone and methyl isopropyl ketone; vinylidene halides such as vinylidene chloride and vinylidene chlorofluoride; and N-vinyl compounds such as N-vinyl pyrrole, N-vinyl carbazole, N-vinyl indole and N-vinyl pyrrolidone divinyl benzene, ethylene glycol dimethacrylate, mixtures thereof; and the like.

In the suspension polymerization technique, other addenda are added to the monomer droplets and to the aqueous phase of the mass in order to ring about the desired result including initiators, promoters and the like which are more particularly disclosed in U.S. Pat. Nos. 2,932,629 and 4,148,741, both of which are incorporated herein by reference.

Useful solvents for the polymer suspension process are those that dissolve the polymer, which are immiscible with water and which are readily removed from the polymer droplets such as, for example, chloromethane, dichloromethane, ethylacetate, vinyl chloride, methyl ethyl ketone, trichloromethane, carbon tetrachloride, ethylene chloride, trichloroethane, toluene, xylene, cyclohexanone, 2-nitropropane and the like. A particularly useful solvent is dichloromethane because it is a good solvent for many polymers while at the same time, it is immiscible with water. Further, its volatility is such that it can be readily removed from the discontinuous phase droplets by evaporation.

The quantities of the various ingredients and their relationship to each other in the polymer suspension process can vary over wide ranges, however, it has generally been found that the ratio of the polymer to the solvent should vary in an amount of from about 1 to about 80% by weight of the combined weight of the polymer and the solvent and that the combined weight of the polymer and the solvent should vary with respect to the quantity of water employed in an amount of from about 25 to about 50% by weight. The size and quantity of the colloidal silica stabilizer depends upon the size of the particles of the colloidal silica and also upon the size of the polymer droplet particles desired. Thus, as the size of the polymer/solvent droplets are made smaller by high shear agitation, the quantity of solid colloidal stabilizer is varied to prevent uncontrolled coalescence of the droplets and to achieve uniform size and narrow size distribution of the polymer particles that result. These techniques provide particles having a predetermined average diameter anywhere within the range of from 0.5 micrometer to about 150 micrometers with a very narrow size distribution. The coefficient of variation (ratio of the standard deviation to the average diameter, as described in U.S. Pat. No. 2,932,629) is normally in the range of about 15 to 35%.

The particular polymer employed to make the beads is a water immiscible synthetic polymer that may be colored. The preferred polymer is any amorphous water immiscible synthetic polymer. Examples of polymer types that are useful are polystyrene, poly(methyl methacrylate) or poly (butyl acrylate). Copolymers such as a copolymer of styrene and butyl acrylate may also be used. Polystyrene polymers are conveniently used.

The materials useful in forming the light sensitive layers and the photographic support useful the invention are those known in the art. They can be employed in any of the ways and in any of the combinations known in the art. Typically, the materials are incorporated in a melt and coated as a layer described herein on a support to form part of a photographic element. When the term "associated" is employed, it signifies that a reactive compound is in or adjacent to a specified layer where, during processing, it is capable of reacting with other components.

Unless otherwise specifically stated, use of the term "group", "substituted" or "substituent" means any group or atom other than hydrogen. Additionally, when reference is made in this application to a compound or group that contains a substitutable hydrogen, it is also intended to encompass not only the unsubstituted form, but also its form further substituted with any substituent group or groups as herein mentioned, so long as the substituent does not destroy properties necessary for the intended utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro, hydroxyl, cyano; carboxyl, or groups which may be further substituted, such as alkyl, including straight or branched chain or cyclic alkyl, such as methyl, trifluoromethyl, ethyl, t-butyl, 3-(2,4-di-t-pentylphenoxy) propyl, cyclohexyl, and tetradecyl; alkenyl, such as ethylene, 2-butene, alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetanido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, andp-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio, acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dibexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired desirable properties for a specific application and can include, for example, hydrophobic groups, solubilizing groups, blocking groups, and releasing or releasable groups. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. Other art recognized combinations of spectral sensitivity and color formation can be employed. The element can contain additional layers, such as filter layers, interlayers, overcoat layers, and subbing layers.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1996, Item 38957, available as described above, which is referred to herein by the term "Research Disclosure". The Sections hereinafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research Disclosure*, Item No. 38957. Certain desirable photographic elements and processing steps, including those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, and color correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305; 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777 and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116, 4,942,117; 4,942,118; U.S. Pat. Nos. 4,959,480; 4,968,594; 4,988,614; 4,992,361; 5,002,864; 5,021,325; 5,066,575; 5,068,171; 5,071,739; 5,100,772; 5,110,942, 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143 823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474; 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the materials useful in the invention may be blocked or coated in protected form as described, for example, in Japanese Application 61/258,249 or U.S. Pat. No. 5,019,492.

The invention may further be used in combination with image-modifying compounds that release PUGS such as "Developer Inhibitor-Releasing" compounds (DIR's). DIR's useful in conjunction with the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783, 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969). Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

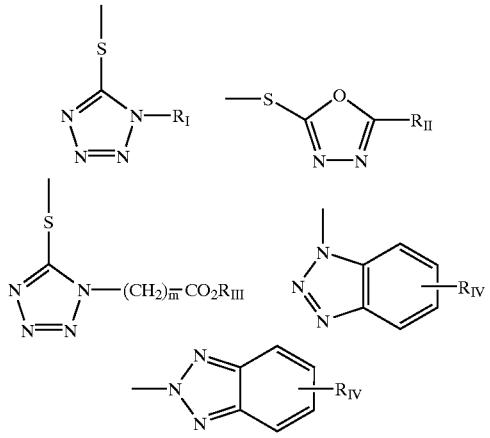

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

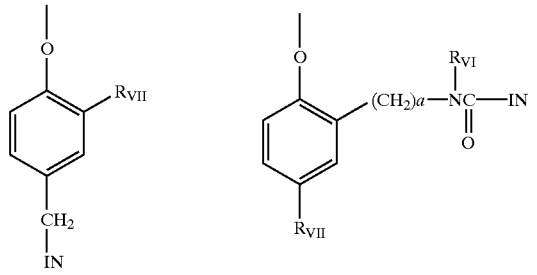

wherein IN is the inhibitor moiety, $R_{VII}$ is selected from the group consisting of nitro, cyano, alkylsulfonyl, sulfamoyl; and sulfonamido groups, a is 0 or 1, and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

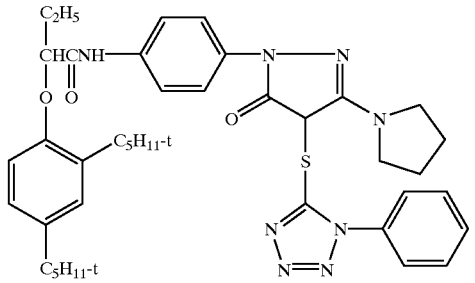

D2

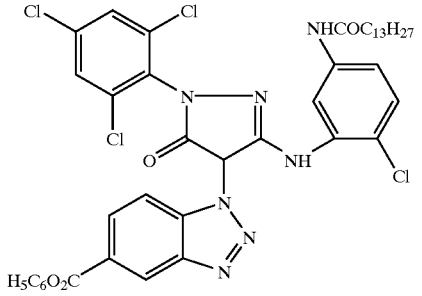

-continued
D3
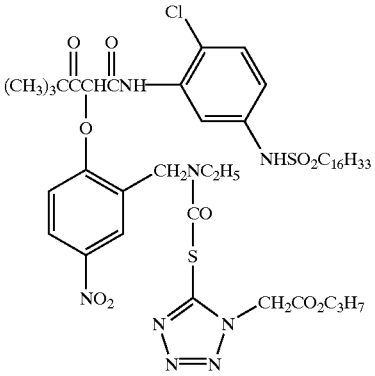
D4
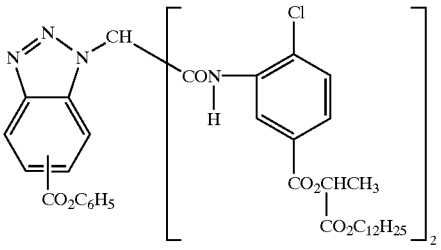
D5
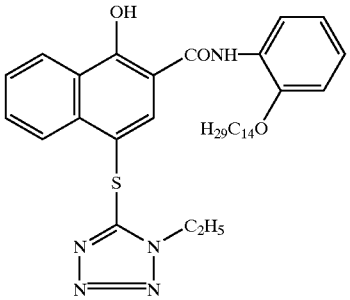
D6
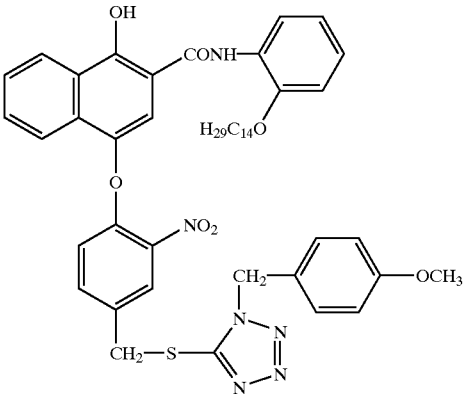
-continued
D7
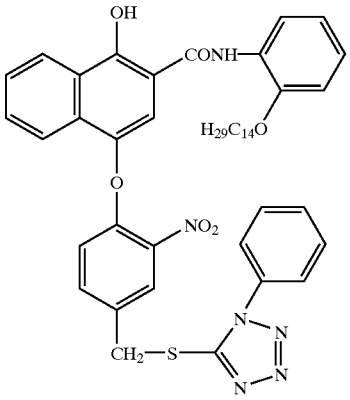
D8
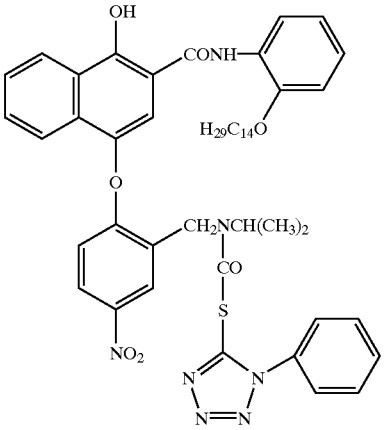
D9
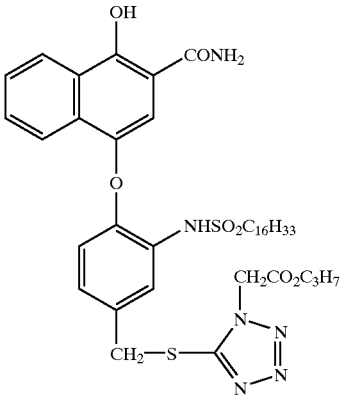

-continued

D10

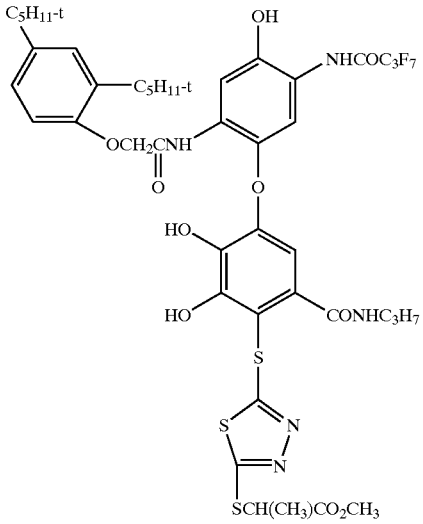

D11

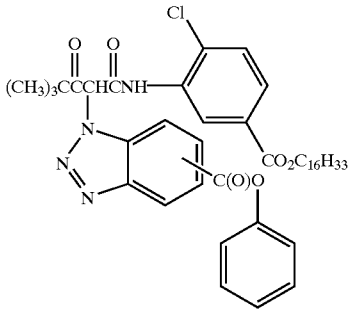

D12

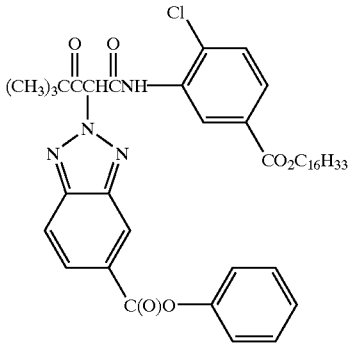

It is also contemplated that the present invention may be employed to obtain reflection materials as described in Research Disclosure, November 1979, Item 18716, available from Kenneth Mason Publications, Ltd, Dudley Annex, 12a North Street, Emsworth, Hampshire P0101 7DQ, England. Materials useful in the invention may be coated on pH adjusted support as described in U.S. Pat. No. 4,917,994; on a support with reduced oxygen permeability (EP 553, 339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666, 90-093,668; 90-094,055; 90-094,056; 90-103,409; 83-62,586; 83-09,959.

Conventional radiation-sensitive silver halide emulsions can be employed in the practice of this invention. Such emulsions are illustrated by *Research Disclosure*, Item 38755, September 1996, I. Emulsion grains and their preparation.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or { 100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al U.S. Pat. Nos. 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride { 100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color-developing agent to reduce developable silver halide and oxidize the color-developing agent. Oxidized color developing agent in turn reacts with the coupler to yield a dye. If desired "Redox Amplification" as described in Research Disclosure XVIIIB(5) may be used.

Elements having excellent light sensitivity are best employed in the practice of this invention. The elements should have a sensitivity of at least about ISO 25, preferably have a sensitivity of at least about ISO 100, and more preferably have a sensitivity of at least about ISO 400. The speed, or sensitivity, of a color negative photographic element is inversely related to the exposure required to enable the attainment of a specified density above fog after processing. Photographic speed for a color negative element with a gamma of about 0.65 in each color record has been specifically defined by the American National Standards Institute (ANSI) as ANSI Standard Number pH 2.27-1981 (ISO (ASA Speed)) and relates specifically the average of exposure levels required to produce a density of 0.15 above the minimum density in each of the green light sensitive and least sensitive color recording unit of a color film. This definition conforms to the International Standards Organization (ISO) film speed rating. For the purposes of this application, if the color unit gammas differ from 0.65, the ASA or ISO speed is to be calculated by linearly amplifying or deamplifying the gamma vs. log E (exposure) curve to a value of 0.65 before determining the speed in the otherwise defined manner.

While standard photographic elements can be employed in this invention, the elements most useful in this invention are designed for capturing an image in machine readable form rather than in a form suitable for direct viewing. In the capture element, speed (the sensitivity of the element to low light conditions) is usually critical to obtaining sufficient image in such elements. Accordingly, the elements, after micro-lens speed enhancement will typically exhibit an equivalent ISO speed of 800 or greater, preferable an equivalent ISO speed of 1600 or greater and most preferably an equivalent ISO speed of 3200 or greater.

The elements will have a latitude of at least 3.0 log E, and preferably a latitude of 4.0 log E, and more preferable a latitude of 5.0 log E or even higher in each color record Such a high useful latitude dictates that the gamma of each color record (i.e. the slope of the Density vs log E after photoprocessing) be less than 0.70, preferably less than 0.60, more preferably less than 0.50 and most preferably less than 0.45. Further, the color interactions between or interimage effects are preferably minimized. This minimization of interimage effect can be achieved by minimizing the quantity of masking couplers and DIR compounds. The interimage effect can be quantified as the ratio of the gamma of a particular color record after a color separation exposure and photo-processing divided by the gamma of the same color record after a white light exposure. The gamma ratio of each color record is preferably between 0.8 and 1.2, more preferably between 0.9 and 1.1 and most preferably between 0.95 and 1.05. Further details of the construction, characteristics quantification of the performance of such scan enabled light sensitive elements and are disclosed in Sowinski et al. U. S. Pat Nos. 6,021,277 and 6,190,847, the disclosures of which are incorporated by reference.

A "color negative element" utilizes negative-working silver halide and provides a negative image upon processing. A first type of such element is a capture element, which is a color negative film that is designed for capturing an image in negative form rather than for viewing an image. A second type of such an element is a direct-view element that is designed, at least in part, for providing a positive image viewable by humans.

In the capture element, speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

A direct-view photographic element is one which yields a color image that is designed for human viewing (1) by reflected light, such as a photographic paper print, (2) by transmitted light, such as a display transparency, or (3) by projection, such as a color slide or a motion picture print. These direct-view elements may be exposed and processed in a variety of ways. For example, paper prints, display transparencies, and motion picture prints are typically produced by digitally printing or by optically printing an image from a color negative onto the direct-viewing element and processing though an appropriate negative-working photographic process to give a positive color image. The element may be sold packaged with instructions for digital printing or for processing using a color negative optical printing process, for example the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less. Color slides may be produced in a similar manner but are more typically produced by exposing the film directly in a camera and processing through a reversal color process or a direct positive process to give a positive color image. The foregoing images may also be produced by alternative processes such as digital printing.

Each of these types of photographic elements has its own particular requirements for dye hue, but in general they all require cyan dyes whose absorption bands are less deeply absorbing (that is, shifted away from the red end of the spectrum) than color negative films. This is because dyes in direct-view elements are selected to have the best appearance when viewed by human eyes, whereas the dyes in image capture materials are designed to best match the needs of the printing process.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal elements are typically sold packaged with instructions to process using a color reversal process such as the Kodak E-6 process as described in The British Journal of Photography Annual of 1988, page 194. Alternatively, a direct positive emulsion can be employed to obtain a positive image.

The above elements are typically sold with instructions to process using the appropriate method such as the mentioned color negative (Kodak C-41), color print (Kodak RA-4), or reversal (Kodak E-6) process.

Preferred color developing agents are p-pbenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

Additionally, the ability to provide rapid and convenient photo processing is greatly facilitated by employing a film designed for easy photofinishing. A dry process film is such a film. In one embodiment, a dry-process film can be characterized as a light sensitive silver halide film having an incorporated developer in a binder on a support and capable of forming a differentiable machine-readable image consisting of a non-diffusible dye by the application of heat. In another embodiment, a dry-process film can be characterized as a light sensitive silver halide film capable of forming a differentiable machine-readable image consisting of a non-diffusible dye by the application of little to no processing solvent and a laminate layer where the dry-process film or the laminate layer has an incorporated developer. In yet another embodiment, a dry-process film can be one characterized as a light sensitive silver halide film capable of forming a differentiable machine-readable image consisting of a non-diffusible dye by the application of developer in limited quantities of processing solvent. Dry process films, photo-processes and photo-processors are well know in the art. Any of these can be usefully employed. Particularly suitable dry-process films and suitable components are described by Irving et al, U.S. Pat. No. 6,242,166, by Szajewski, et al, U.S. Pat. No. 6,048,110, by Ishikawa et al, U.S. Pat. Nos. 5,756,269 and 5,858,629, by Ishikawa, U.S. Pat. No. 6,022,673, by Kikuchi, U.S. Pat. Nos. 5,888,704 and 5,965,332, by Okawa, et al, U.S. Pat. No. 5,851,749, by Takeuchi, U.S. Pat. No. 5,851,745, by Makuta et al, U.S. Pat. No. 5,871,880, by Morita, et al, U.S. Pat. No. 5,874,203, by Asami et al, U.S. Pat. No. 5,945,264, by Kosugi et al, U.S. Pat. No. 5,976,771, and by Ohkawa et al, U.S. Pat. No. 6,051,359.

The films of the invention can be provided as sheets or spooled for easy loading in cameras. This typically is accomplished by slitting the cast films to an appropriate width, chopping the film to an appropriate length, edge—perforating the film to enable proper mechanical transport, providing informational mechanical, magnetic or exposure marking as part of manufacture and spooling the film on a spool. A spool minimally has a core for supporting the film. The spool can additionally have other art known structures. The photographic element of the invention can be incorporated into exposure structures intended for repeated use or exposure structures intended for limited use, variously referred to by names such as "single use cameras", "lens with film", or "photosensitive material package units".

Since a specific spatial arrangement of camera lens, micro-lens and light sensitive layers is required for the invention, care must be taken with the direction of spooling and loading of film elements into a camera for imagewise exposure and in photo-processing the imagewise exposed film. When the micro-lens, light sensitive layers and flexible support components of an integral light sensitive unit according to the invention are arranged with the light sensitive layers between the micro-lenses and the support (type A), then the integral light sensitive unit can be spooled and optionally mounted in a cartridge, cassette or otherwise with the micro-lens side wound side-in to a spool so as to be fully compatible with common cameras, photo-processing units and scanners, optical printers and such. However, when the micro-lens, light sensitive layers and flexible support components of an integral light sensitive unit according to the invention are arranged with the support between the micro-lenses and the light sensitive layers (type B), then the integral light sensitive unit can be spooled and optionally mounted in a cartridge, cassette or otherwise with the micro-lens side wound side-in to a spool or wound side-out to a spool with distinct ancillary requirements for cameras, photo-processing units and scanners. When a type B integral light sensitive unit is spooled with the integral micro-lenses wound side-in, then the spooled unit can be loaded and imagewise exposed in a normally configured camera body. However, photoprocessing, scanning or optical printing are facilitated by a face-to face reversal, i.e. a 180 degree twist, of the integral film so as to allow easy access of photoprocessing agents to the light sensitive layers and to ensure proper optics and scene direction during scanning or printing with commonly designed photoprocessing, scanning or printing units. Alternatively, the photoprocessing, scanning or printing units can be re-designed to accept these reverse wound spools. When a type B integral light sensitive unit is spooled with the integral micro-lenses wound side-out, then the spooled unit can be loaded and imagewise exposed in re-configured camera body. The camera body is re-configured so that the light from the camera lens strikes the micro-lenses before reaching the light sensitive layers. Here photo-processing, scanning or optical printing are as commonly provided.

The scanning can be performed at a spatial pitch that is coarser than the spatial pitch of the fractured image thereby under-sampling the fractured image. In another embodiment, the scanning can be performed at a spatial pitch that is finer than the spatial pitch of the fractured image thereby over-sampling the fractured image. In yet another embodiment, can be performed at a spatial pitch that matches than the spatial pitch of the fractured image thereby recording the fractured image.

Image data can also be processed after scanning to ensure the fidelity of color data in advance of the recovery of image information from the dots or the interdot area. The signal transformation techniques disclosed can be further modified so as to deliver an image that incorporates the look selected by a customer as described by Szajewski et al in EP 1164 778 and EP 1182 858, the disclosures of which are incorporated by reference. Matrices and look-up tables (LUTs) can provide useful image transformation.

In one variation, the R, G, and B image-bearing signals from scanner are converted to an image metric which corresponds to that from a single reference image-recording device or medium and in which the metric values for all input media correspond to the trichromatic values which would have been formed by the reference device or medium had it captured the original scene under the same conditions under which the input media captured that scene. In another variation, if the reference image recording medium was chosen to be a specific color negative film, and the intermediary image data metric was chosen to be the predetermined R', G', and B' intermediary densities of that reference film, then for an input color negative film according to the invention, the R, G, and B image-bearing signals from a scanner would be transformed to the R', G', and B' intermediary density values corresponding to those of an image which would have been formed by the reference color negative film had it been exposed under the same conditions under which the actual color negative recording material was exposed. The result of such scanning is digital image data that is representative of the image that has been captured on film.

It is to be appreciated that while the image is in electronic or digital form, the image processing is not limited to the specific manipulations described above. While the image is in digital form, additional image manipulation may be used including, but not limited to, scene balance algorithms (to determine corrections for density and color balance based on the densities of one or more areas within the processed film), tone scale manipulations to adjust film underexposure gamma or overexposure gamma non-adaptive or adaptive sharpening via convolution or unsharp masking, red-eye reduction, and non-adaptive or adaptive grain-suppression. Moreover, the image may be artistically manipulated, zoomed, cropped, and combined with additional images or other manipulations as known in the art.

Once the image has been corrected and any additional image processing and manipulation has occurred, the image may be electronically transmitted to a remote location or locally written to a variety of output devices including, but not limited to, film recorder, printer, thermal printers, electrophotographic printers, ink-jet printers, display, CD or DVD disks magnetic electronic signal storage disks, and other types of storage devices and display devices known in the art. Besides digital manipulation, the digital images can be used to change physical characteristics of the image, such as "windowing" and "leveling" or other manipulations known in the art. Further, output image-bearing signals can be adapted for a reference output device, can be in the form of device-specific code values or can require further adjustment to become device specific code values. Such adjustment may be accomplished by further matrix transformation or look-up table transformation, or a combination of such transformations to properly prepare the output image-bearing signals for any of the steps of transmitting, storing, printing, or displaying them using the specified device.

The entire contents of the patents and other publications referred to in this specification are incorporated herein by reference.

PARTS LIST

101. Camera taking lens
103. Light sensitive element
105. Micro-lens array
107. Micro-lens
201. Element
203. Micro-beads
205. Micro-bead layer
207. Light-sensitive layers/support
209. Element
211. Micro-beads
213. Micro-bead layer
215. Light-sensitive layers/support
217. Element
219. Micro-beads
221. Micro-bead layer
223. Light-sensitive layers/support
301. Element
303. Micro-beads
305. Micro-bead layer
307. Light-sensitive layers and support
401. Micro-beads
403. Micro-bead layer
405. Support
407. Blue sensitive layer unit
409. Interlayer
411. Green sensitive layer unit
413. Interlayer
415. Red sensitive layer unit
417. Antihalation layer
501. Micro-beads
503. Micro-bead layer
505. Interlayer
507. Blue light sensitive unit
509. Interlayer
511. Green light sensitive unit
513. Interlayer
515. Red light sensitive unit
517. Antihalation layer
519. Support

What is claimed is:

1. A light sensitive element in spooled form comprising a support, at least one light sensitive silver halide emulsion layer, and a micro-bead layer comprising micro-beads and a binder wherein the quantity of binder in the micro-bead layer is such that the micro-beads form a protrusion, thereby enabling the beads to function as microlenses.

2. The element of claim 1 wherein said micro-bead layer is the outermost layer of said element.

3. The element of claim 1 wherein the micro-bead layer is situated on an opposing side of the support relative to the light sensitive silver halide layer.

4. The element of claim 1 wherein the micro-bead layer is situated on the same side of the support relative to the light sensitive silver halide layer.

5. The element of claim 1 wherein the material that comprises the micro-lenses is selected so that the lenses are not altered by photo processing.

6. The element of claim 1 wherein the material that comprises the micro-lenses is selected so that the lenses are altered by photo processing.

7. The element of claim 1 wherein the ratio of the refractive index of said micro-beads to the refractive index of said binder is between 0.8 and 1.2.

8. The element of claim 1 wherein the ratio of the refractive index of said micro-beads to the refractive index of said binder is between 0.9 and 1.1.

9. The element of claim 1 wherein the ratio of the refractive index of said micro-beads to the refractive index of said binder is between 0.95 and 1.05.

10. The element of claim 1 wherein the ratio of the projected area of said micro-beads to the projected area of said element is at least 0.20.

11. The element of claim 1 wherein the ratio of the projected area of said micro-beads to the projected area of said element is at least 0.50.

12. The element of claim 1 wherein the ratio of the projected area of said micro-beads to the projected area of said element is at least 0.80.

13. The element of claim 1 wherein said micro-beads enable a speed increase of at least 0.15 log E compared to the same the same element without the beads.

14. The element of claim 3 wherein the ratio of the bead diameter to the support thickness is between 0.8 and 1.2.

15. The element of claim 4 wherein the micro-lens layer is separated from the nearest light sensitive layer by an interlayer and the ratio of the bead radius to the interlayer thickness is between 0.8 and 1.2.

16. The element of claim 4 wherein the micro-lens layer is adjacent to a light sensitive layer.

17. A combination camera and light sensitive photographic element suitable for image capture followed by machine reading to produce a single perspective two-dimensional color image, said combination comprising:

(A) a camera having a lens system for capturing a single image perspective, and containing (B) a photographic element of claim 1.

18. The combination of claim 17 wherein the element contains a red light sensitive silver halide emulsion layer unit, a green light sensitive silver halide emulsion layer unit, and a blue light sensitive silver halide emulsion layer unit.

19. The element of claim 1 exhibiting a sensitivity of at least ISO-25.

20. A method of imaging comprising the step of imagewise exposing an element according to claim 1.

21. A method of image formation comprising the step of photo-processing an imagewise exposed light sensitive element according to claim 1.

22. The method of claim 21 additionally comprising a development step.

23. A method of image formation comprising the step of scanning or optically printing an imagewise exposed and developed light sensitive element according to claim 1.

24. A method of imaging comprising the step of forming a digital representation of an image obtained by scanning an imagewise exposed and developed light sensitive element according to claim 1.

25. A method of imaging comprising the step of digitally altering, storing, transmitting or displaying a digital representation of an image obtained by scanning an imagewise exposed and developed light sensitive element according to claim 1.

26. An element according to claim 1 supplied in spooled form with the micro-lens face of the element wound side-in relative to a spool core.

27. An element according to claim 1 supplied in spooled form with the micro-lens face of the element wound side-out relative to a spool core.

28. A camera pre-loaded with an element according to claim 1.

29. The camera of claim 28 wherein the ratio of the camera lens f-number to the micro-lens f-number is greater than 1.4.

30. The element of claim 1 comprising a dye forming coupler.

31. The element of claim 1 comprising a release dye.

32. A combination camera and light sensitive photographic element suitable for image capture followed by machine reading to produce a single perspective two-dimensional color image, said element comprising:

(A) a camera having a lens system for capturing a single image perspective, and (B) the element of claim 1.

33. A light sensitive element comprising a support, at least one light sensitive silver halide emulsion layer, and a micro-bead layer comprising micro-beads and a binder, wherein the quantity of binder in the micro-bead layer is such that the micro-beads form a protrusion, thereby enabling the beads to function as microlenses, wherein the material that comprises the micro-lenses is selected so that the lenses are altered by photo processing.

34. The element of claim 33 wherein the ratio of the refractive index of said micro-beads to the refractive index of said binder is between 0.8 and 1.2.

35. The element of claim 33 wherein said micro-beads enable a speed increase of at least 0.15 log E compared to the same the same element without the beads.

36. The element of claim 33 wherein the lenses are altered by being destroyed or removed.

37. A combination camera and light sensitive photographic element suitable for image capture followed by machine reading to produce a single perspective two-dimensional color image, said combination comprising:

(A) a camera having a lens system for capturing a single image perspective, and containing (B) a light sensitive element comprising a support, at least one light sensitive silver halide emulsion layer, and a micro-bead layer comprising micro-beads and a binder wherein the quantity of binder in the micro-bead layer is such that the micro-beads form a protrusion, thereby enabling the beads to function as microlenses, wherein the element contains a red light sensitive silver halide emulsion layer unit, a green light sensitive silver halide emulsion layer unit, and a blue light sensitive silver halide emulsion layer unit.

38. A method of imaging comprising the step of forming a digital representation of an image obtained by scanning an imagewise exposed and developed light sensitive element comprising a support, at least one light sensitive silver halide emulsion layer, and a micro-bead layer comprising micro-beads and a binder wherein the quantity of binder in the micro-bead layer is such that the micro-beads form a protrusion, thereby enabling the beads to function as microlenses.

39. The method of claim 38 comprising the step of digitally altering, storing, transmitting or displaying a digital representation of an image.

40. The method of claim 38 wherein the material that comprises the micro-lenses is selected so that the lenses are altered by photo processing.

41. The method of claim 38 wherein the lenses are altered by being destroyed or removed.

42. A camera pre-loaded with an element comprising a support, at least one light sensitive silver halide emulsion layer, and a micro-bead layer comprising micro-beads and a binder wherein the quantity of binder in the micro-bead layer is such that the micro-beads form a protrusion, thereby enabling the beads to function as microlenses, wherein the ratio of the camera lens f-number to the micro-lens f-number is greater than 1.4.

43. The pre-loaded camera of claim 42 wherein the f number of the microlens is from 1.5 to 16.

44. A light sensitive element comprising a support, at least one light sensitive silver halide emulsion layer, and a micro-bead layer comprising micro-beads and a binder, wherein the quantity of binder in the micro-bead layer is such that the micro-beads form a protrusion, thereby enabling the beads to function as microlenses, the light sensitive silver halide emulsion layer further comprising a dye forming coupler.

45. The element of claim 44 wherein the element includes a coupler capable of forming at least one cyan, magenta, yellow, or black dye.

46. A light sensitive element comprising a support, at least one light sensitive silver halide emulsion layer, and a micro-bead layer comprising micro-beads and a binder, wherein the quantity of binder in the micro-bead layer is such that the micro-beads form a protrusion, thereby enabling the beads to function as microlenses, the light sensitive silver halide emulsion layer further comprising a release dye.

47. A light sensitive element comprising a support, a red light sensitive silver halide emulsion layer unit, a green light sensitive silver halide emulsion layer unit, and a blue light sensitive silver halide emulsion layer unit, and a micro-bead layer comprising polymeric micro-beads wherein the quantity of binder in the micro-bead layer is such that the micro-beads are not fully enclosed by the binder, thereby enabling the beads to function as microlenses.

48. The element of claim 47 wherein the ratio of the projected area of said micro-beads to the projected area of said element is at least 0.2.

* * * * *